US005909085A

United States Patent [19]

Nelson

[11] Patent Number: 5,909,085

[45] Date of Patent: Jun. 1, 1999

[54] HYBRID LUMINOSITY CONTROL SYSTEM FOR A FLUORESCENT LAMP

[75] Inventor: Leonard Y. Nelson, Seattle, Wash.

[73] Assignee: Korry Electronics Co., Seattle, Wash.

[21] Appl. No.: 08/820,458

[22] Filed: Mar. 17, 1997

[51] Int. Cl.[6] ..... H05B 39/00

[52] U.S. Cl. ..... 315/94; 315/108; 315/118

[58] Field of Search ..... 315/94, 112, 115, 315/117, 118, 151, 158, 108; 313/13, 15, 46, 11, 565

[56] References Cited

U.S. PATENT DOCUMENTS

| | | | |
|---|---|---|---|
| 3,309,565 | 3/1967 | Clark et al. . | |
| 3,526,802 | 9/1970 | Wainio . | |
| 3,619,697 | 11/1971 | Evans . | |
| 3,815,047 | 6/1974 | Smith et al. . | |
| 3,898,511 | 8/1975 | Johnson et al. . | |
| 4,020,378 | 4/1977 | Morehead . | |
| 4,105,910 | 8/1978 | Evans . | |
| 4,145,634 | 3/1979 | Evans et al. . | |
| 4,431,947 | 2/1984 | Ferriss et al. . | |
| 4,529,912 | 7/1985 | Northrup et al. . | |
| 4,533,853 | 8/1985 | Hammond et al. . | |
| 4,972,118 | 11/1990 | Yorifuji et al. | 313/565 |
| 4,978,890 | 12/1990 | Sekiguchi et al. | 315/117 |
| 5,204,584 | 4/1993 | Ikeda et al. . | |
| 5,274,305 | 12/1993 | Bouchard | 315/108 |
| 5,428,265 | 6/1995 | Booth, Jr. et al. . | |
| 5,612,593 | 3/1997 | Olson | 315/117 |

OTHER PUBLICATIONS

Ono, Tetsuo, et al., "Luminous Build–up Characteristics of a Compact Fluorescent Lamp with Two Separate Inner Tubes," *Journal of the Illuminating Engineering Institute of Japan*, vol. 68, No. 10, 1984, pp. 524–527. (Translation provided).

Bloem, J. et al., "Some New Mercury Alloys for Use in Fluorescent Lamps," *Journal of the Illuminating Engineering Society*, Apr. 1977, pp. 141–147.

Siminovitch, M.J., et al., "Maintaining Optimum Optimum Fluorescent Lamp Performance Under Elevated Temperature Conditions," Lighting Systems Research Group, University of California, Berkeley, undated.

Serres, A.W., et al., "A Method to Improve the Performance of Compact Fluorescent Lamps," *Journal of the Illuminating Engineering Society*, Summer 1993, pp. 40–48.

Serres, Anthony W., et al., "Amalgams and Compact Fluorescent Lamps," IEEE, 1993, pp. 2296–2304.

*Primary Examiner*—Don Wong
*Assistant Examiner*—Haissa Philogene
*Attorney, Agent, or Firm*—Christensen O'Connor Johnson & Kindness PLLC

[57] ABSTRACT

A luminosity control system (10) for a fluorescent lamp (12) that has a glass enclosure (18) and a pair of lead wires (14) at each end of the glass enclosure is provided. A filament (16) is electrically coupled to each pair of lead wires. An amalgam (22) is located adjacent each filament. The amalgam releases mercury into the glass enclosure upon activation of the fluorescent lamp. A wrapped wire heater (24) is in thermal contact with a first portion of the exterior surface of the glass enclosure. The heater and a thermoelectric cooler (36) raise the temperature of the fluorescent lamp to a level above the temperature at which the fluorescent lamp produces maximum visible light as determined by mercury pressure within the glass enclosure while the amalgam releases mercury into the fluorescent lamp. Thereafter, the thermoelectric cooler (36) maintains a portion of the glass enclosure at this temperature.

24 Claims, 5 Drawing Sheets

FILAMENT POWER SUPPLY
HEATER POWER SUPPLY
CONTROLLER
TEC POWER SUPPLY
10
12
14
14
14
14
18
19
21
23
24
25
26
28
30
32
34
36
38
40
44
46
48
52

HYBRID LUMINOSITY CONTROL SYSTEM FOR A FLUORESCENT LAMP

FIELD OF THE INVENTION

The present invention relates to lighting control systems and, more particularly, to lighting control systems for fluorescent lamps.

BACKGROUND OF THE INVENTION

Fluorescent lamps are used as light sources in a wide variety of applications. These applications include consumer and industrial applications, such as home and office lighting. Fluorescent lamps are also used in a number of more demanding applications. For example, fluorescent lamps are used in backlights for displays, such as active matrix liquid crystal displays (AMLCD). From a weight point of view, when compared to cathode ray tube displays, AMLCDs are ideally suited for use in aerospace applications, such as primary flight instrument displays. Unfortunately, aircraft, particularly military aircraft, are often operated in extremely cold temperatures. Because extremely cold temperatures can affect a fluorescent lamp's performance, extremely cold temperatures can affect an AMLCD display that is backlit by a fluorescent lamp. The present invention is directed to reducing the effect of extremely cold temperatures on the performance of fluorescent lamps.

The electrical energy delivered to a fluorescent lamp is converted to visible light emission by mercury atoms. During the fabrication of a fluorescent lamp, liquid mercury is injected into a glass enclosure that defines a lamp wall. Depending upon the temperature of the fluorescent lamp wall, a fixed portion of the bulk mercury vaporizes and becomes part of the discharge gas mixture. Most of the discharge gas mixture is formed by a single rare gas, such as argon, or a mixture of rare gases, such as neon and argon. The rare gas atoms act as a buffer and produce little useful light output.

The mercury atoms are excited to upper energy levels by collisions with energetic electrons in the discharge gas mixture. Some of the excited mercury atoms emit UV radiation while returning to their ground state. The UV radiation activates a phosphor coating on the interior of the fluorescent lamp wall that produces visible light. The magnitude of the visible light output of the fluorescent lamp is determined by the mercury pressure, which is proportional to the temperature of the fluorescent lamp. The visible light output of the fluorescent lamp is maximized at an optimum temperature and corresponding mercury pressure.

FIG. 1 shows that, for a fluorescent lamp having an enclosure with a small diameter, such as 15 mm, the optimum temperature is about 50° C. If the temperature is below the optimum temperature, mercury atoms condense onto the lamp wall or other cold internal surface, such as filament leads, and the UV radiation production rate is reduced. This decreases the visible light output from the fluorescent lamp. Raising the temperature above the optimum temperature leads to further increases in the mercury atom concentration. This causes radiation trapping, or imprisonment of the UV light, and a corresponding decrease in lamp efficiency.

In some environments, such as military aircraft, it is desirable that primary flight instruments reach flight readiness within one to ten minutes. This means that the displays associated with such instruments also become flight ready within this period of time. In the case of an AMLCD backlit by a fluorescent lamp, this means that the fluorescent lamp must reach peak output in a short time period (0.5 to 2 minutes). In the past, this has been difficult, if not impossible, to achieve when the military aircraft is located in a low-temperature region, such as the Arctic.

At low temperatures, mercury vapor condenses on the lamp wall and/or the electrodes of a fluorescent lamp. As a result, the visible light output of the fluorescent lamp is restricted by the warmup rate of the mercury within a fluorescent lamp. It is known in the art to accelerate the warmup rate of the mercury within the fluorescent lamp by passing an electrical current through a small diameter wire wrapped around the exterior of the fluorescent lamp. Even with this modification, it may take several minutes for the wire, acting as a heater, to raise the temperature of the glass enclosure to the temperature and corresponding mercury pressure at which the peak light output of the fluorescent lamp is maximized. This time depends upon available heater power and ambient temperatures.

It is also known to increase the concentration of mercury atoms in a fluorescent lamp by attaching an amalgam material to the electrode assembly of the fluorescent lamp. The amalgam material forms an alloy with the mercury. When the electrode is heated prior to initiation of the gas discharge, the mercury is released by the amalgam attached to the electrode. Excess mercury is thus introduced into the discharge gas mixture and the fluorescent lamp reaches peak luminosity almost instantaneously. Unfortunately, the mercury in the amalgam material is depleted within one to two minutes. If the entire fluorescent lamp does not reach its optimum operating temperature within this time period, mercury liberated from the amalgam material will condense at the coldest spot within the fluorescent lamp. The visible light output from the fluorescent lamp is reduced once the mercury content of the amalgam is exhausted.

The use of a silver amalgam in the electrode assembly of fluorescent lamps designed for consumer applications to improve the cold-start performance has been suggested. See *The Journal of the Illuminating Engineering Institute of Japan*, Vol. 68, No. 10, October 1984, pp. 524–527. The intended application is an energy-saving fluorescent replacement for a standard, screw-in type incandescent lamp. Other amalgam materials, such as indium, bismuth-indium and lead-tin-bismuth, also have been used to improve the visible light output of a fluorescent lamp at startup over a wide range of temperatures. See Bloem, Bouwknegt and Wesselink, *Journal of the Illuminating Engineering Society*, April 1977, pp. 141–147. Unfortunately, at low temperatures, an indium amalgam releases too much mercury. This excessive release interferes with fluorescent lamp ignition. It also causes mercury to deposit on and blacken the ends of a fluorescent lamp wall.

The use of two different amalgam compositions to regulate mercury pressure at low and high temperatures is also known. A dual amalgam combination allows a fluorescent lamp to operate over a wider temperature range than does a single amalgam. Because a dual amalgam approach suffices for fluorescent lamps designed for consumer applications that are not subject to a wide temperature range, further luminosity control measures are neither necessary nor cost effective. Unfortunately, a dual amalgam cannot regulate mercury pressure throughout the range of ambient temperatures encountered in aerospace and military applications.

In addition to the low-temperature performance deficiencies discussed above, some conventional amalgam materials are difficult to use in some fluorescent lamps because of manufacturing requirements. For example, in order to improve usable life, manufacturing specifications require that the entire fluorescent lamp structure of serpentine lamps, of the type typically used for backlighting avionics displays, be heated to several hundreds of degrees centigrade during manufacturing. These temperatures are well above the melting point of many common amalgam materials. Indium's melting point is 157° C. The inclusion of an amalgam with a low melting point entails the use of processing methods that are more time consuming and complex than are the processing methods used when the chosen amalgam materials have high melting points. Further, lower fluorescent lamp processing temperatures can shorten the lifetime of fluorescent lamps by not sufficiently baking out impurities.

It is also known that the light output of a fluorescent lamp can be held constant after warmup by controlling the temperature of a spot on the wall of a fluorescent lamp using a solid state cooling device, such as a Peltier cooler. See U.S. Pat. Nos. 3,309,565 and 4,529,912, for example. As discussed in these patents, in the past, the use of Peltier devices to maintain the output of fluorescent lamps at a desired level as ambient temperature varies has been suggested. However, because Peltier devices are costly, this technology has not been implemented. Rather, dual amalgam combinations have been widely used as low-cost alternatives to Peltier devices. Neither approach has been used to decrease the warmup of fluorescent lamps designed for use in low-temperature climates.

The present invention is directed to providing a fluorescent lamp that is ideally suited for use in the backlight of AMLCDs designed for military aircraft and other displays intended to be operable in low-temperature conditions that overcomes the foregoing and other disadvantages of fluorescent lamps intended to be operable in such conditions. While designed for use in the backlight of AMLCDs intended for use in military aircraft displays, it is to be understood that fluorescent lamps formed in accordance with the present invention may also find use in other environments, including other types of military vehicles.

SUMMARY OF THE INVENTION

In accordance with this invention, a hybrid luminosity control system that maintains a near-optimum mercury pressure over a wide range of ambient temperatures is provided. The control system includes a combination of silver amalgam material, a wire wrap heater and a lamp wall "cold spot." More specifically, the hybrid luminosity control system combines a fast-response amalgam with a slower response, wire wrap heater to provide maximum light output throughout a warmup phase. During and following warmup, a temperature-stabilized cold spot regulates mercury pressure to a desired level. Desired mercury pressure is the mercury pressure at which the fluorescent lamp produces the maximum amount of visible light. Preferably, the cold spot temperature is actively regulated by a thermoelectric cooling (TEC) device. Mercury will condense at the cold spot if the rest of the lamp wall has a higher temperature.

In accordance with more detailed aspects of this invention, the hybrid luminosity control system controls the operation of a fluorescent lamp that has a glass enclosure and a filament at each end of the glass enclosure. An amalgam is located adjacent each filament. The amalgam releases mercury into the glass enclosure upon application of power to the hot cathode filament. A heater in thermal contact with a first portion of the exterior surface of the glass enclosure raises the temperature of the first portion of the glass enclosure to a first temperature while the amalgam releases mercury into the glass enclosure. A spot cooler maintains a second portion of the glass enclosure at the first temperature even if the temperature of the first portion of the glass enclosure exceeds the first temperature, whereby the mercury pressure is maintained at the desired pressure.

In accordance with further aspects of the present invention, the amalgam is formed from silver metal that is plated or mechanically attached to the filament lead wire.

In accordance with another aspect of the present invention, the heater includes a wire that is in thermal communication with the external surface of the glass enclosure. A heater power supply supplies electrical power to the heater wire. A heater temperature sensor that is in thermal communication with the external surface of the glass enclosure supplies a feedback signal that is used to control the operation of the heater power supply.

In accordance with still another aspect of the present invention, the spot cooler is a solid state, active thermoelectric cooler (TEC) device. A TEC power supply supplies electrical power to the thermoelectric cooling device. A TEC temperature sensor that is in thermal communication with the exterior surface of the glass enclosure supplies a feedback signal that is used to control the operation of the TEC power supply. The TEC can be used to provide supplementary heating during warmup as well as to provide cooling during subsequent operation.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

While, as will be better understood from the following discussion, the invention was developed for and is described in connection with AMLCDs designed for military and civilian aircraft intended to be operational in low-temperature climates, it is to be understood that the invention may also find use in other areas. In addition to AMLCDs used in other environments, such as portable computers, some aspects of the invention may also be useful with other types of backlit displays—backlit signs and backlit displays. Finally, some aspects of the invention may also be useful in fluorescent lamps designed for consumer and light industrial applications, such as home and office lighting.

Figure 1:
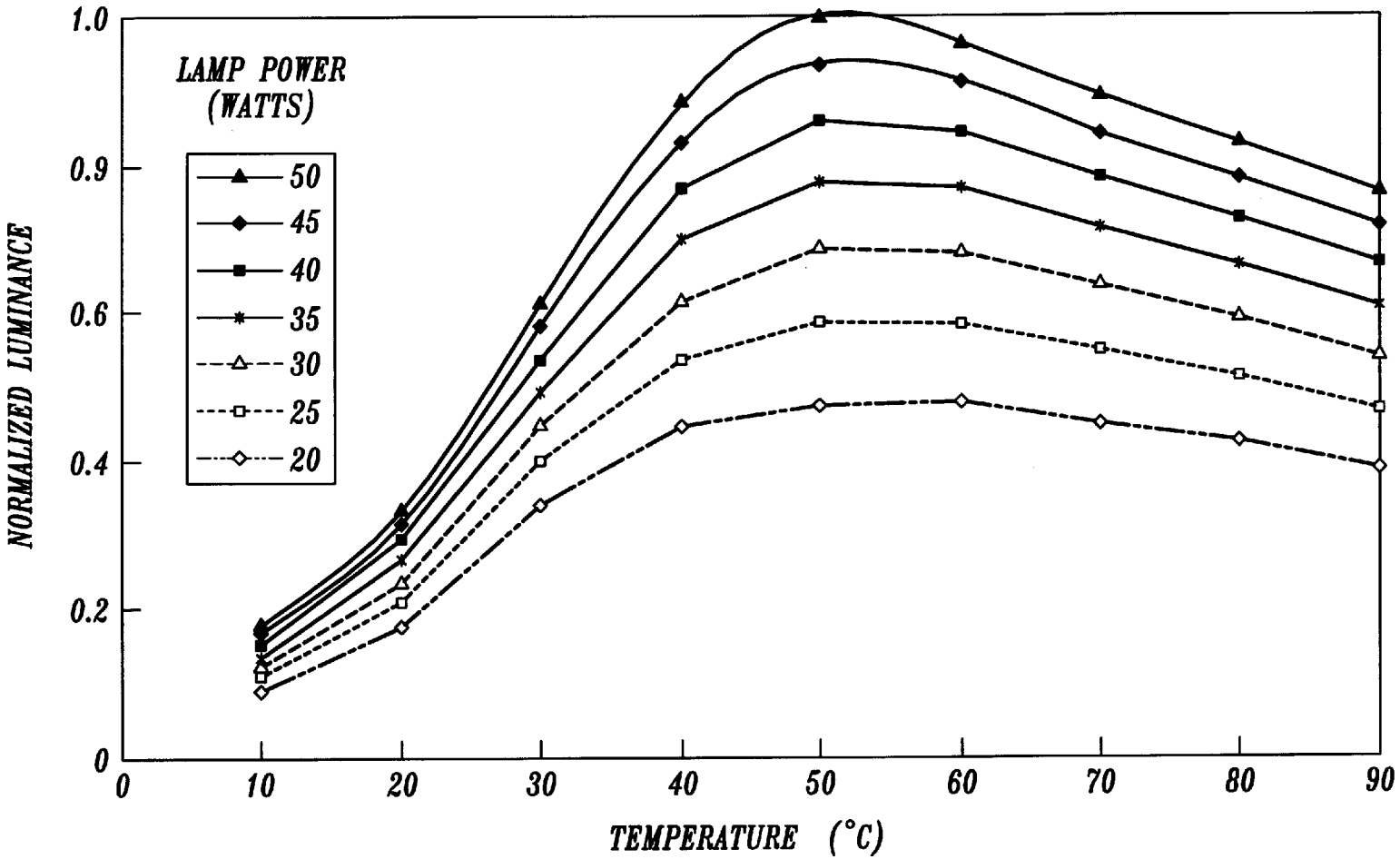
FIG. 1 is a graph showing fluorescent lamp luminosity versus temperature.
Figure 2:
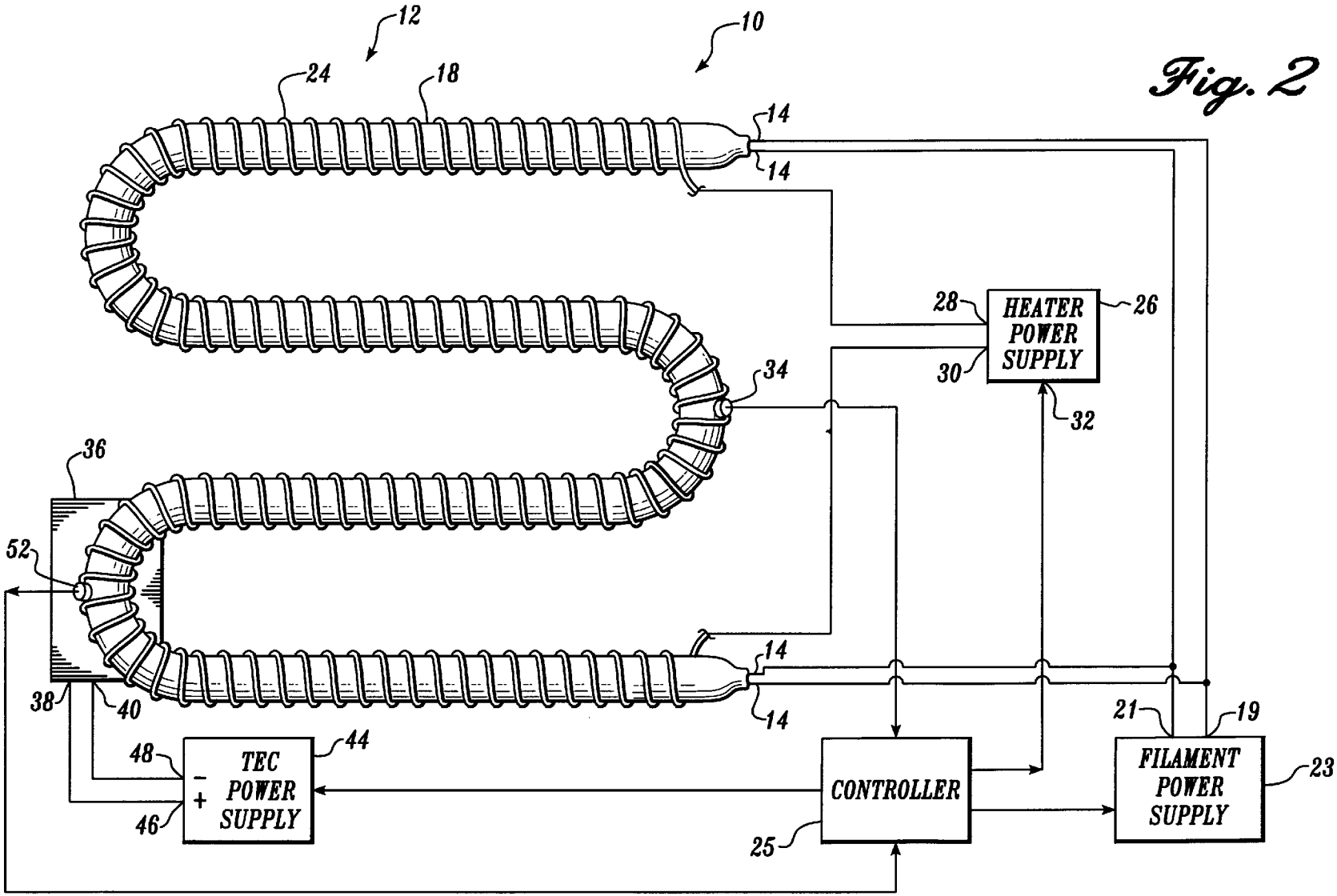
FIG. 2 is a schematic diagram of a hybrid luminosity control system according to the present invention.

FIG. 2 is a schematic diagram of a hybrid luminosity control system 10 formed in accordance with the invention in combination with a serpentine shaped fluorescent lamp 12. The hybrid luminosity control system 10 includes three subsystems, an amalgam subsystem, a heater subsystem and a thermoelectric cooler (TEC) subsystem. The three subsystems coact with one another to provide a luminosity control system that rapidly raises the mercury pressure in the fluorescent lamp 12 to an optimum level and maintains the level during the warmup phase and thereafter over a wide range of temperatures.

Turning first to the amalgam system, each end of the fluorescent lamp 12 includes a pair of lead wires 14 and a filament 16 (FIG. 3) mounted across the ends of the lead wires 14 located inside the glass enclosure 18 of the fluorescent lamp 12, as is well known in the fluorescent lamp art. The filament 16 is a hot cathode filament, as is also well known in the art. The outer ends of the lead wires 14 are connectable to the terminals 19 and 21 of a filament power supply 23. The filament power supply 23 is controlled by a controller 25 that also controls the power supplies of the heater and TEC subsystems of the hybrid luminosity control system 10 in the manner hereinafter described.

Figure 3:
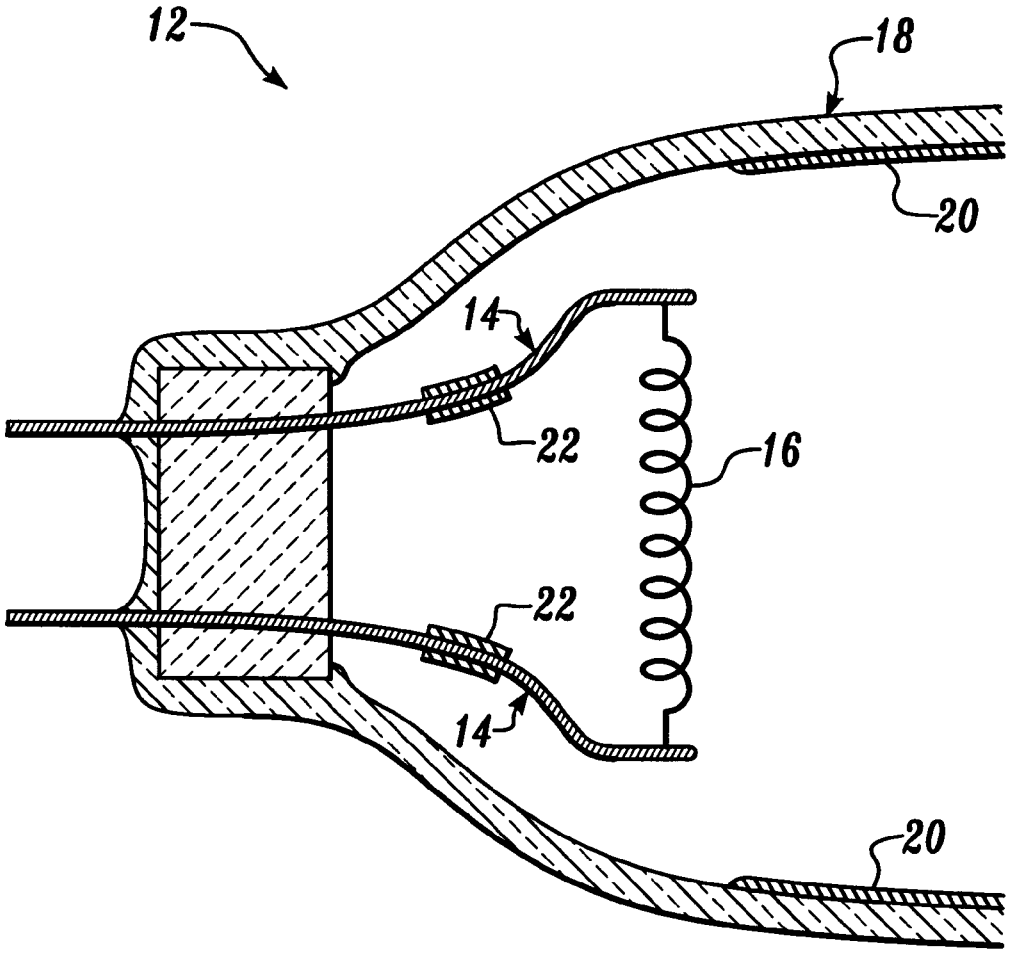
FIG. 3 is a detail of the hybrid luminosity control system of FIG. 2.

Referring now to FIGS. 2 and 3, a phosphor coating 20 is applied to the inside of the glass enclosure 18, in any suitable manner well known to those in the fluorescent lamp art. As with the electrodes and the phosphor coating, the glass enclosure 18 is formed by methods well known to those in the fluorescent lamp art. The serpentine shape of the lamp 12 helps to evenly distribute the fluorescent lamp's illumination over a large planar display area, such as an AMLCD area. Optical elements combined with the fluorescent lamp 12 cause the illumination to be uniform over the entire area of the display and also to direct the illumination into a desired viewing cone, such as ±45° of horizontal and ±10° of vertical. See, for example, the illumination system described in copending U.S. patent application Ser. No. 08/576,767, assigned to Korry Electronics Co., which is hereby incorporated herein by reference.

Located within the fluorescent lamp 12 are pieces of silver metal that react with mercury to form an amalgam 22. The amalgam 22 introduces mercury into the discharge gas mixture as soon as power is applied to the electrodes by the filament power supply 23. The introduction of mercury into the discharge gas mixture causes the fluorescent lamp 12 to reach peak luminosity almost instantaneously. More specifically, as shown in FIG. 3, a piece of amalgam 22 is preferably plated onto the inner ends of the lead wires 14. Alternately, a metal mesh of amalgam having a sufficient surface area can be positioned in close proximity to each filament 16. The latter approach is not preferred because it requires a fastening means to prevent movement of the metal mesh under high shock and vibration conditions. Regardless of location, when preignition power is applied, the filaments 16 almost instantaneously produce heat. Thereafter, when ignition power is applied the resulting discharge forms an arc spot directly on the filament 16. The arc spot serves to maintain a portion of the filament 16 close to its optimum temperature of about 1000° C. At this temperature, a coating of the filament 16 releases a sufficient number of electrons to help stabilize the discharge gas mixture. The heat produced by the filaments 16 causes the adjacent amalgam 22 to rapidly release the mercury stored in the amalgam.

The preferred amalgam 22 is a silver amalgam because silver amalgams have performance and manufacturing advantages over other amalgams. For example, a silver amalgam 22 introduces mercury into the discharge gas mixture faster than other amalgams, such as bismuth-indium or lead-tin-bismuth.

Silver amalgam 22 has a shorter recovery period than some other amalgams following shutdown of the lamp 12, such as an indium amalgam. That is, following shutdown, it takes less time for mercury vapor to diff-use back to a silver amalgam and be reabsorbed onto the silver amalgam surface than other amalgams. The diffusion and recombination of mercury into an amalgam are dependent upon time, temperature, and amalgam material. If the diffusion and recombination processes are incomplete when a lamp is restarted, the time to reach maximum light output increases. The recovery time for a silver amalgam is on the order of one to five hours compared to about 15 hours for an indium amalgam. This makes silver the preferred amalgam when fast recovery time is critical.

Silver metal is also preferred for the mercury amalgam forming material because it has a melting point of 961° C. A high melting point amalgam forming material allows the use of higher processing temperatures when a fluorescent lamp is manufactured. Higher processing temperatures have the benefit of baking out a greater amount of the impurities that are present during the manufacture of a fluorescent lamp. Increasing the amount of impurity removed during manufacture increases the life of a fluorescent lamp, an important factor in the choice of fluorescent lamps used in military applications.

Referring back to FIG. 2, the heater subsystem of the hybrid luminosity control system 10 includes a wire wrap heater 24, a heater power supply 26, and a heater temperature sensor 34. The wire wrap heater 24 is spirally wrapped around the outside of the glass enclosure 18 of the fluorescent lamp 12 over the entire length of the lamp. The wire wrap heater 24 is formed by a heating wire, preferably a ductile, thin diameter (e.g., approximately 0.01 inches) wire made of a resistive alloy, such as copper/nickel. The heater wire is tightly wrapped around the outside of the glass enclosure 18 of the fluorescent lamp 12. Preferably, the wire wrap heater 24 is fastened to the glass enclosure 18 by a high-temperature, transparent adhesive, such as adhesive No. 3145 available from Dow Corning, Midland, Mich., to ensure good thermal contact with the wall of the fluorescent lamp 12. Preferably, the resistivity of the wire is selected such that sufficient power can be dissipated in the wire to heat the glass enclosure 18 of the fluorescent lamp 12 above 50° C. in a short time period.

The heater power supply 26 is connected to the wire wrap heater 24. The heater power supply 26 has a first output terminal 28 and a second output terminal 30. One end of the wire wrap heater 24 is connected to the first terminal 28, and the other end of the wire wrap heater 24 is connected to the second terminal 30. The heater power supply 26 also includes a control terminal 32. Like the filament power supply 23, the heater power supply can be either an AC power supply or a DC power supply.

The control terminal 32 is connected to an output of the controller 25. The heater temperature sensor 34 is mounted to the outside of the glass enclosure 18 of the fluorescent lamp 12 and is connected to the controller 25. The heater temperature sensor may be formed by any suitable thermoelectric device, such as a thermistor, that controls a signal such that its magnitude is proportional to sensed temperature.

In operation, the heater power supply 26 applies power to the wire wrap heater 24. The heater temperature sensor 34 senses the temperature of the glass enclosure 18 and provides a temperature-related feedback signal that is used by the controller 25 to control the power applied to the wire wrap heater 24 by the heater power supply 26 such that a predetermined temperature (e.g., 50° C.) is maintained inside the glass enclosure 18.

Still referring to FIG. 2, the TEC subsystem of the hybrid luminosity control system 10 includes a thermoelectric cooler (TEC) 36 attached in thermal communication to the outside of the glass enclosure 18, a TEC power supply 44, and a TEC temperature sensor 52. Preferably, the TEC 36 is an active, solid state thermoelectric cooler, such as a Peltier device. As well known to those familiar with thermoelectric coolers, DC current flow through a TEC causes heat to be transferred from one side of the TEC to the other, creating a cold side and a hot side. Reversing the DC current flow reverses the hot and cold sides. The TEC 36 may be a single-stage TEC or a multistage TEC, as required by the environment in which the invention is to be used. A single-stage TEC can achieve a temperature difference between the lamp wall and the ambient environment adequate to sustain a cold spot temperature equal to the preferred temperature of operation—50° C. A multistage TEC should be used where the heat load produced in a display enclosure incorporating the invention is very high and/or the ambient temperature of the operating environment is likely to be very high.

The TEC 36 is electrically connected to the TEC power supply 44. The TEC power supply 44 is a DC power supply having two output terminals 46 and 48 whose polarity can be switched. The TEC power supply output terminals 46 and 48 are electrically connected to the power input terminals 38 and 40 of the TEC 36.

The TEC temperature sensor 52 is mounted on the glass enclosure 18 of the fluorescent lamp 12 in the region of the TEC. The TEC temperature sensor 52 is suitably a thermoelectric device, such as a thermistor, that controls a signal such that its magnitude is proportional to temperature. The TEC temperature sensor 52 is electrically connected to the controller 25 and the controller 25 is connected to a control terminal 50 of TEC power supply 44. As with the heater temperature sensor 34, the TEC temperature sensor 52 provides a temperature-related feedback signal. The TEC temperature sensor feedback signal is used by the controller 52 to control the polarity and amount of current applied to the TEC 36 by the TEC power supply 44, so that a desired temperature is produced or maintained in the region of the glass enclosure adjacent the TEC.

As will be better understood from the following description of the operation of the embodiment of the invention shown in FIGS. 2 and 3, the silver amalgam subsystem, the heater subsystems, and the TEC subsystem coact to create a hybrid luminosity control system that rapidly creates and then maintains a near-optimum mercury pressure (approximately 10 millitorr) in the glass enclosure 18 over a wide range of ambient temperatures. This is accomplished by rapidly releasing mercury from the amalgam, rapidly raising the temperature of the entire glass enclosure above the temperature that corresponds to the near-optimum mercury pressure—suitably to at least 65° C. and preferably to 75° C., for example—by the time the mercury release from the amalgam is complete, and then maintaining the temperature of a small portion of the glass enclosure lamp surface at the level (approximately 50° C.) that corresponds to the near optimum mercury pressure.

As noted above, the fluorescent lamp 12 of the invention was developed for use in the backlight of avionics displays, specifically AMLCDs used in military (or civilian) aircraft. In such environments, after use, the fluorescent lamp 12 normally will be deactivated for a period of time long enough for the silver amalgam 22 to have substantially fully recovered.

When it is desired to activate an airplane display or other device embodying the present invention, the controller 25 is enabled. When the controller is enabled, the fluorescent lamp 12 is energized in a conventional manner by the filament power supply 23 supplying power to the lead wires 14. As a result, the filaments 16 produce heat and the pieces of amalgam 22 introduce mercury into the discharge gas mixture. At the same time, the controller 25 causes the heater power supply to apply power to the wire wrap heater 24 and the TEC power supply to supply power to the TEC 36. The polarity of the TEC power is such that, initially, the TEC produces heat. After warmup, the polarity of the TEC power supply output shifts to cause the TEC to operate in a cooling mode rather than a heating mode.

Figure 4:
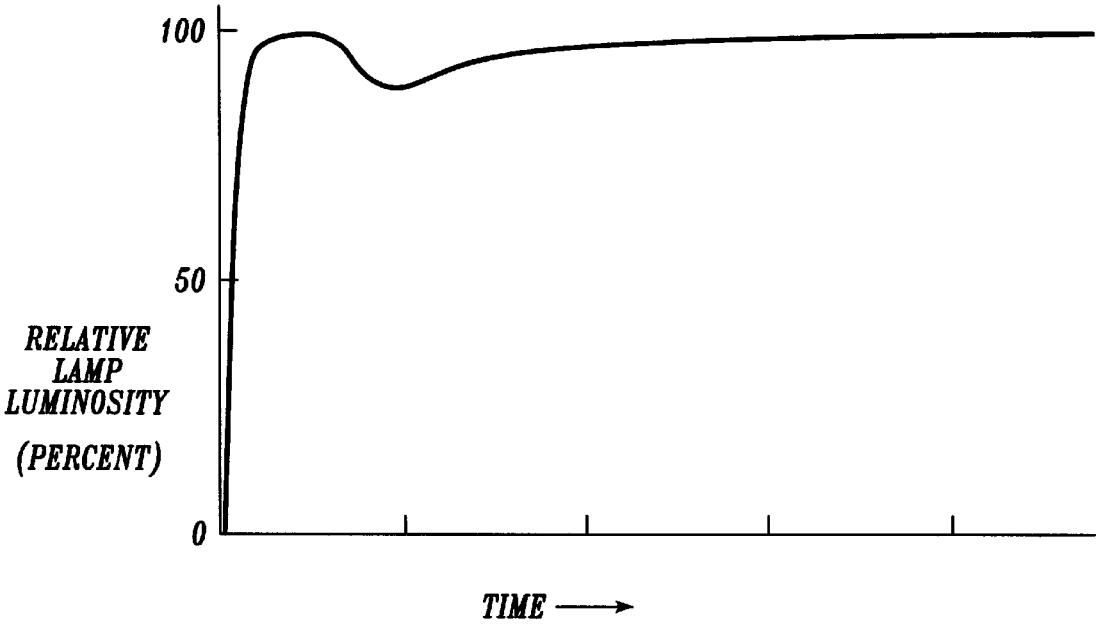
FIG. 4 is a graph of fluorescent lamp luminosity versus time for a fluorescent lamp having a hybrid luminosity control system formed in accordance with the present invention.

FIG. 4 shows the time history of the luminosity of the fluorescent lamp 12 following a cold start from below 0° C. Upon energization, mercury is released by the pieces of silver amalgam 22. The release of mercury from the pieces of silver amalgam 22 creates an initial luminosity spike. The luminosity spike is followed by a slight luminosity dip and then a steady luminosity plateau. The depth and length of the dip are minimized by rapidly raising the overall glass enclosure 18 temperature to the temperature (approximately 50° C.) that corresponds to the optimum pressure in the glass enclosure 18 (approximately 10 millitorr). The rapid temperature rise is created by the wire wrap heater 24 and the TEC 36. Preferably, the temperature of the glass enclosure 18 is heated to a temperature above the desired temperature, i.e., 50° C., before the mercury produced by the pieces of silver amalgam 22 is exhausted. Once the fluorescent lamp 24 reaches the luminosity plateau level, normally no further external heating of the lamp will be necessary because the gas discharge itself will produce heat sufficient to maintain the glass enclosure 18 at or above the desired temperature, i.e., 50° C. For example, the temperature of the glass enclosure 24 may be raised suitably to at least 65° C. and preferably to 75° C. or so at startup, to ensure that no cold spots are present on the fluorescent lamp 12 wall. At this elevated temperature, the temperature sensor 34 provides a feedback signal that is used by the controller 25 to deactivate the heater power supply 26 and the TEC 36, if the TEC 36 is producing heat. In the absence of some control mechanism, the discharge gas could maintain the temperature of the glass enclosure 18 above the desired temperature after the heater power supply 26 is deactivated. If this were to occur, luminosity would fall. The TEC 36 provides the required control mechanism.

Figure 5:
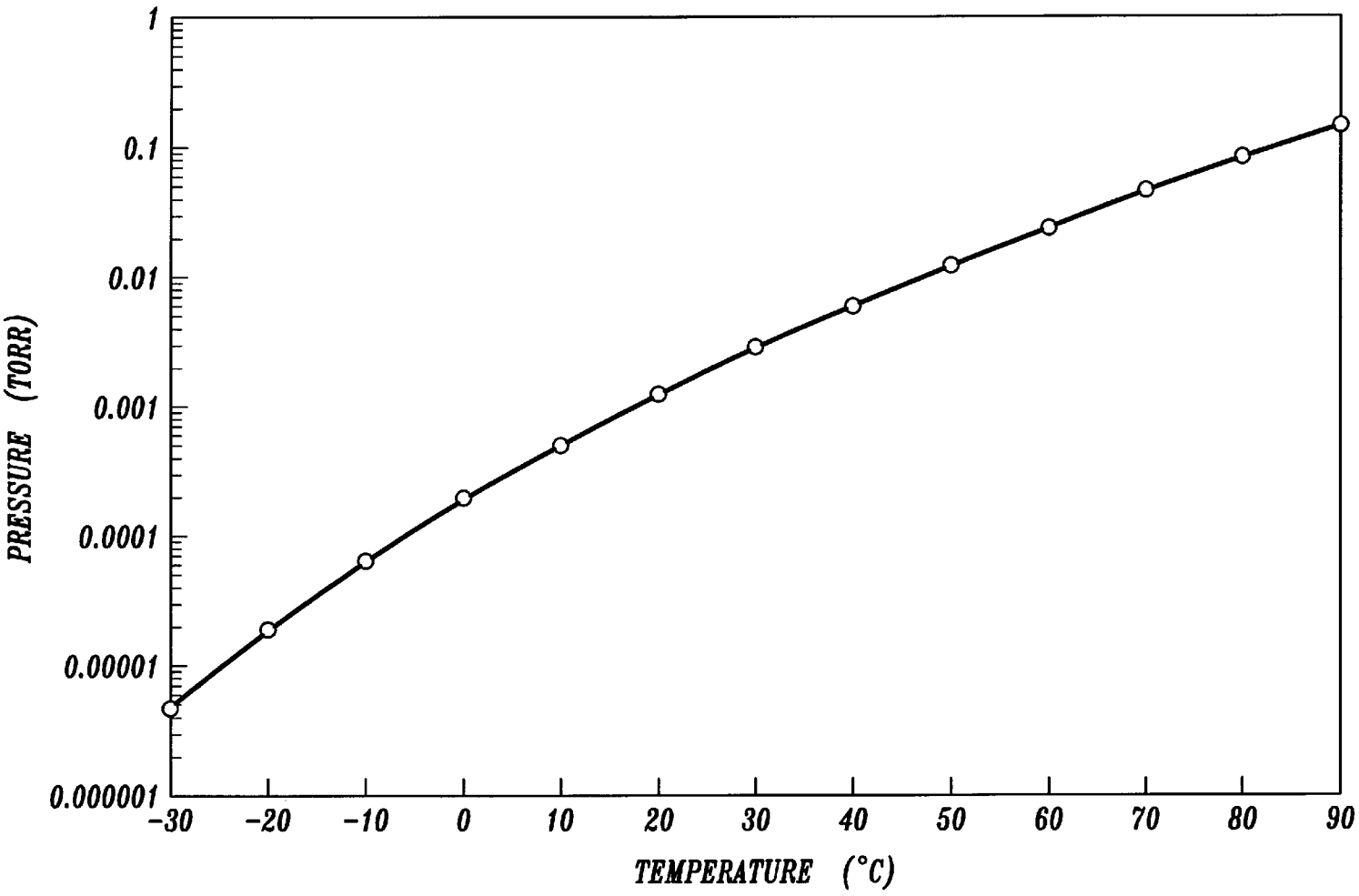
FIG. 5 is a graph of mercury vapor pressure versus temperature for a fluorescent lamp having a hybrid luminosity control system formed in accordance with the present invention.

FIG. 5 shows the relationship between mercury vapor pressure and temperature for a fluorescent lamp of the type shown in FIGS. 2 and 3. At 50° C. the corresponding mercury vapor pressure is approximately 10 millitorr. Because mercury vapor pressure is the principal parameter governing the luminosity of the fluorescent lamp 12, it is desirable to maintain the mercury vapor pressure at the desired pressure (approximately 10 millitorr) when the temperature exceeds the optimum value. This is accomplished by the TEC 36.

As discussed below, the TEC 36 produces a cold spot on a small portion of the wall of the glass enclosure 18 that regulates the mercury vapor pressure by allowing the mercury to condense at a location that is cooler than the remainder of the glass enclosure wall when the temperature in the glass enclosure exceeds the desired temperature of 50° C. The cold spot is held at the optimum luminosity temperature, i.e., 50° C. More specifically, the controller 25 uses the feedback signal produced by the TEC temperature sensor 52 to regulate the amount of current produced by the TEC power supply 44 so as to maintain the cold spot temperature at the optimum value.

As noted above, the controller 25 has the capability of reversing the polarity of the DC current supplied to the TEC 36. This polarity reversal causes the TEC 36 to switch from a cooling mode to a heating mode. As also noted above, this feature can be used during cold start, if desired, when the fluorescent lamp 12 wall is colder than the optimum temperature. Preferably, the TEC 36 is operated in this reverse mode during a cold start, or shutdown. Otherwise, the TEC 36 will reduce the temperature rise created by the wire wrap heater 24. Once the temperature sensor 52 registers a glass enclosure temperature of 50° C. or above, the polarity of the TEC power supply output should be returned to "normal" so that the TEC 36 can create a cool spot on the wall of the glass enclosure 18.

If desired, the TEC 36, which is active, can be replaced with a passive cooling system. In such a system, a nearby surface (a "cold wall") is maintained at approximately 50° C. A small area, approximately one square inch, of the wall of the glass enclosure is thermally connected to the cold wall by a bonding pad of thermally conductive adhesive, such as adhesive No. 2939 available from NuSil Technologies, Carpinteria, Calif. The rest of the wall of the glass enclosure of the fluorescent lamp is thermally isolated from the cold wall and mounted in an enclosure with thin metal fingers, or pads, of low-conductivity adhesive, such as Loctite. Thermally isolating the lamp wall facilitates the rapid warmup of the lamp wall by the wire wrap heater 24. During startup, the output of the heater sensor 34 is used to cause the deactivation of the heater power supply 26 when the temperature of the fluorescent lamp 12 wall reaches a suitable value, such as 65° C., or a preferable value of 75° C.

While the preferred embodiment of the invention has been illustrated and described, it will be appreciated that various changes can be made therein without departing from the spirit and scope of the invention. For example, the heater power supply 26 and the TEC power supply 44 could include controllers and the feedback signals produced by the heater temperature sensor 34 and the TEC temperature sensor 52 could be sent directly to such controllers, respectively. Also, while the wire wrap heater 24 is shown as a single wire extending the entire length of the glass enclosure 18, it could be created in sections, each individually controllable. The heater could also be formed by a transparent coating of conductive material, such as indium tin oxide (ITO), on the exterior glass wall of the lamp. Further, the individual power supplies 23, 26, and 44 could be replaced by a common controllable power supply with multiple outputs. Hence, within the scope of the appended claims, it is to be understood that the invention can be practiced otherwise than as specifically described herein.

The embodiments of the invention in which an exclusive property or privilege is claimed are defined as follows:

1. A luminosity control system for a fluorescent lamp, the fluorescent lamp including a glass enclosure having a length dimension, at least one pair of lead wires that extends into the glass enclosure and a filament located in the glass enclosure that is electrically coupled to the lead wires, for producing heat in the glass enclosure when electrical power is applied to the filament, the luminosity control system comprising:

an amalgam located in the glass enclosure adjacent said filament, the amalgam releasing mercury into the glass enclosure when electrical power is applied to the lead wires and the filament produces heat; and a heater in thermal contact with the exterior surface of the glass enclosure along substantially the entire length of the glass enclosure for raising the temperature inside the glass enclosure as the amalgam releases mercury into the glass enclosure.

2. The luminosity control system of claim 1, wherein the amalgam is a silver amalgam.

3. The luminosity control system of claim 2, wherein the silver amalgam is plated onto the lead wires.

4. The luminosity control system of claim 1, wherein the heater includes a heater wire wrapped around the exterior surface of the glass enclosure.

5. The luminosity control system of claim 4, wherein the heater also includes a heater power supply electrically coupled to the heater wire to apply electrical power to the heater wire.

6. The luminosity control system of claim 5, wherein the heater also includes a heater temperature sensor mounted in thermal communication with the external surface of the glass enclosure, the heater temperature sensor being electrically coupled to the heater power supply, to control the amount of electrical power applied to the heater wire by the heater power supply.

7. The luminosity control system of claim 1, further comprising a spot cooler thermally coupled to a portion of the glass enclosure for maintaining the portion at a predetermined temperature.

8.The luminosity control system of claim 7, wherein the spot cooler includes a thermoelectric cooler.

9. The luminosity control system of claim 8, wherein the spot cooler also includes a thermoelectric cooler power supply electrically coupled to the thermoelectric cooler to apply electrical power to the thermoelectric cooler.

10. The luminosity control system of claim 9, wherein the spot cooler also includes a thermoelectric cooler temperature sensor in thermal communication with the glass enclosure adjacent the thermoelectric cooler, the thermoelectric cooler temperature sensor being electrically coupled to the thermoelectric cooler power supply to control the amount of electrical power applied to the thermoelectric cooler by the thermoelectric cooler power supply.

11. A luminosity control system for a fluorescent lamp, the fluorescent lamp having a glass enclosure, at least one pair of lead wires that extends into the glass enclosure, and a filament located in the glass enclosure that is electrically coupled to the lead wires for producing heat in the glass enclosure when electrical power is applied to the lead wires, the luminosity control system comprising:

an amalgam located in the glass enclosure adjacent said filament, the amalgam releasing mercury into the glass enclosure when electrical power is applied to the lead wires and the filament produces heat;

a heating element in thermal contact with the exterior surface of the glass enclosure for raising the temperature inside the glass enclosure as the amalgam releases mercury into the glass enclosure;

a heating element temperature sensor attached in thermal communication with said glass enclosure in the region of said heating element;

a spot cooling device in thermal communication with a portion of the glass enclosure for controlling the temperature inside the glass enclosure;

a spot cooling device temperature sensor in thermal communication with said portion of said glass enclosure; and a power and control system coupled to said lead wires, said heating element, said heating element temperature sensor, said spot cooling device and said spot cooling device temperature sensor for receiving temperature information from said heating element temperature sensor and said spot cooling device temperature sensor and for applying electrical power to said lead wires, said heating element and said spot cooling device such that the temperature in said glass enclosure is rapidly raised above a predetermined temperature after power is first applied to said lead wires and thereafter said portion of said glass enclosure is maintained at said predetermined temperature.

12. The luminosity control system of claim 11, wherein said amalgam is a silver amalgam.

13. The luminosity control system of claim 12, wherein said silver amalgam is plated onto said lead wires.

14. The luminosity control system of claim 11, wherein said heating element comprises wire wrapped around said glass enclosure.

15. The luminosity control system of claim 12, wherein said spot cooling device is a thermoelectric cooler.

16. The luminosity control system of claim 15, wherein said thermoelectric cooler assists in heating the glass enclosure until the temperature of said glass enclosure rises above said predetermined temperature and then cools said portion of said glass enclosure to said predetermined temperature.

17. The luminosity control system of claim 16, wherein said predetermined temperature is 50° C.

18. The luminosity control system of claim 11, wherein said spot cooling device is a thermoelectric cooler.

19. The luminosity control system of claim 18, wherein said thermoelectric cooler assists in heating the glass enclosure until the temperature of said glass enclosure rises above said predetermined temperature and then cools said portion of said glass enclosure to said predetermined temperature.

20. The luminosity control system of claim 19, wherein said predetermined temperature is 50° C.

21. The luminosity control system of claim 11, wherein said predetermined temperature is 50° C.

22. A method of controlling the luminosity of a fluorescent lamp, the fluorescent lamp including a glass enclosure having a length dimension and at least one pair of lead wires that extends into the glass enclosure and a filament located in the glass enclosure that is electrically coupled to the lead wires for producing heat in the glass enclosure when electrical power is applied to the lead wires, the method comprising:

releasing mercury from an amalgam into the glass enclosure upon application of electrical power to the lead wires;

raising the temperature of the glass enclosure by applying heat to the glass enclosure along substantially the entire length of the glass enclosure to above a predetermined temperature while the amalgam releases mercury into the glass enclosure; and cooling a portion of the glass enclosure to the predetermined temperature after the temperature of the glass enclosure is raised above the predetermined temperature.

23. The method of claim 22, wherein the temperature of the glass enclosure is raised above 65° C. while the amalgam releases mercury into the glass enclosure.

24. The method of claim 23, wherein the temperature of the portion of the glass enclosure is cooled to 50° C. after the temperature of the glass enclosure is raised above 65° C.

* * * * *